United States Patent [19]

Björk et al.

[11] Patent Number: 4,708,062

[45] Date of Patent: Nov. 24, 1987

[54] ARMING DEVICE FOR SEA MINES

[76] Inventors: Jan Björk, Rödhakegatan 2, S-260 23 KÅgeröd; Sven G. Svensson, Ängsgatan 8, S-261 39 Landskrona, both of Sweden

[21] Appl. No.: 843,320

[22] Filed: Mar. 24, 1986

Related U.S. Application Data

[63] Continuation of Ser. No. 619,220, filed as PCT SE83/00352, Oct. 1,3, 1983, published as WO84/01619, Apr. 26, 1984, abandoned.

[30] Foreign Application Priority Data

Oct. 15, 1982 [SE] Sweden ..... 8205855

[51] Int. Cl.[4] ..... F42C 15/10

[52] U.S. Cl. ..... 102/420

[58] Field of Search ..... 102/420, 419, 416, 223, 102/228, 229, 263

[56] References Cited

U.S. PATENT DOCUMENTS

| | | | |
|---|---|---|---|
| 2,827,850 | 3/1958 | Muzzey, Jr. | 102/430 |
| 2,945,440 | 7/1960 | Vogt | 102/420 |
| 2,960,030 | 11/1960 | Semon | 102/420 |
| 2,968,240 | 1/1961 | Booth | 102/402 |
| 3,195,460 | 7/1965 | Kalaf | 102/420 |
| 3,532,057 | 10/1970 | Aubrey | 102/392 |
| 3,782,282 | 1/1974 | Bjork | 102/420 |
| 4,369,709 | 1/1983 | Backstein et al. | 102/420 |

FOREIGN PATENT DOCUMENTS 18868 6/1914 Denmark .

*Primary Examiner*—Charles T. Jordan

[57] ABSTRACT

Arming device for sea mines comprising an electric detonator, a transfer charge and an interruptor which can be inserted between the detonator and the transfer charge for separating the detonator and the transfer charge; the detonator is arranged as part of a separate unit which can be inserted into a space in a housing arranged in the arming device; cooperating electric contacts are arranged on the unit and in the space, respectively, for the electric connection of the detonator at the insertion thereof into the space.

17 Claims, 5 Drawing Figures

ARMING DEVICE FOR SEA MINES

Figure 1:
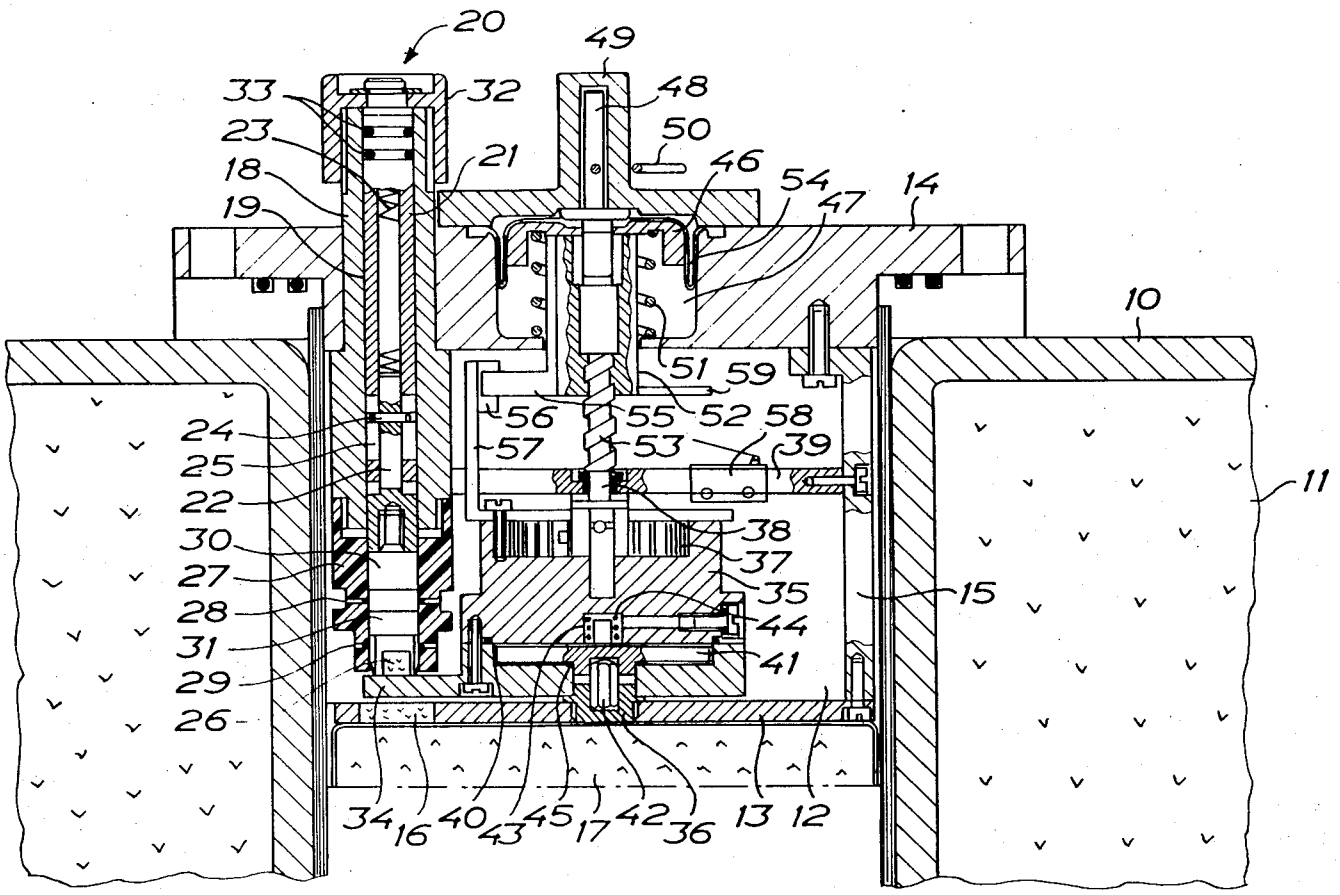

This is a continuation of application Ser. No. 619,220, filed as PCT SE83/00352, Oct. 13, 1983, published as WO84/01619, Apr. 26, 1984, now abandoned.

The invention relates to an arming device for sea mines, comprising an electric detonator, a transfer charge and an interruptor which can be introduced between the detonator and the transfer charge to separate the detonator and the transfer charge from each other.

The explosive system, the explosive train, of a sea mine typically can be built up by an electric detonator, containing some 60 mg of a high sensitive explosive such as silver-azide, and some 60 mg of e.g. PETN, a transfer charge containing a few grammes of tetryl, a booster charge containing say 1 kg of RDS/TNT, and a main charge containing say 100–600 kg of TNT.

From the safety point of view one makes a distinction between explosives more sensitive than tetryl (e.g. silver-azide) and explosives which have a sensitivity equal to or lower than that of tetryl. According to actual international standards, explosives more sensitive than tetryl, normally should be prevented from transferring a detonation by means of a physical obstruction (interruptor), so that the explosive train is positively interrupted by mechanical means until arming is required. Then, the physical obstruction should remain positively locked in the safe position under all envisaged environmental conditions other than those for correct operation. The system should remain safe for a specified distance of travel after launching, firing or release or in dependence on other parameters, and in case of an arming device for sea mines the parameters usually comprise the time after launching and a certain minimum depth. Within the specified limits the system must not function if it should hit an obstacle or should receive a firing or releasing signal.

The arming device of a sea mine thus should keep the explosive train positively interrupted during storage and transport and for a certain time after launching of the sea mine, which can be obtained by providing a metallic obstruction (interruptor) between the detonator and the transfer charge. Then, the interruptor should have a time-delayed withdrawal motion, and the withdrawal normally starts immediately upon launching and will be completed e.g. half an hour later when the arming thus is effected. However, the arming device also has another function: it shall operate electric switches in a programmed sequence, by which the batteries of the mine are connected to the electronic system of the mine shortly after launching and the electric detonator is kept short-circuited alternatively completely disconnected and is connected to the firing system of the mine shortly before arming.

Known arming devices generally are designed such that the detonator is mounted in connection with the assembly of the device and afterwards is no longer accessible from the outside of the mechanism (the mine), i.e. the detonator after mounting forms an integral part of the arming device. This is in agreement with the international standards mentioned above, but in some countries, inter alia in Sweden, it is prescribed that the detonator and the booster charge must not be present in the mine simultaneously during storage and transport (during peace time). In order to satisfy this requirement e.g. one mine manufacturer has designed the mine in such a way that the booster charge is easily accessible and can be stored outside the mine then to be quickly inserted in connection with the preparation of the mine for combat. This is, however, not a practical solution due to the fact that a separate storage room for the booster charges is required, which should be well separated from the room wherein the mines are stored.

The purpose of the invention is to provide a considerably more attractive and practical solution of the problem of keeping the detonator and the booster charge separated during storage and transport and at the same time to make possible safe and reliable arming of the mine when it has been launched, and this purpose is achieved by the arming device of the kind referred to above having obtained the characteristics according to claim 1. Thus, the detonator can be stored separately outside the arming device, and since the detonator contains a small amount of explosive only, it is in most cases sufficient that the detonator is stored in a detonation-proof enclosure attached to the mine. Thus, the storing problem associated with the prior art arrangement mentioned above and including a separate booster charge, is eliminated and at the same time it is achieved that the mine is available in a complete condition to be rapidly made ready for combat by the simple and easily effected step of mounting the detonator in the mine.

In order to explain the invention in more detail reference is made to the accompanying drawings which disclose an embodiment of the arming device according to the invention.

In the drawings

Figure 2:
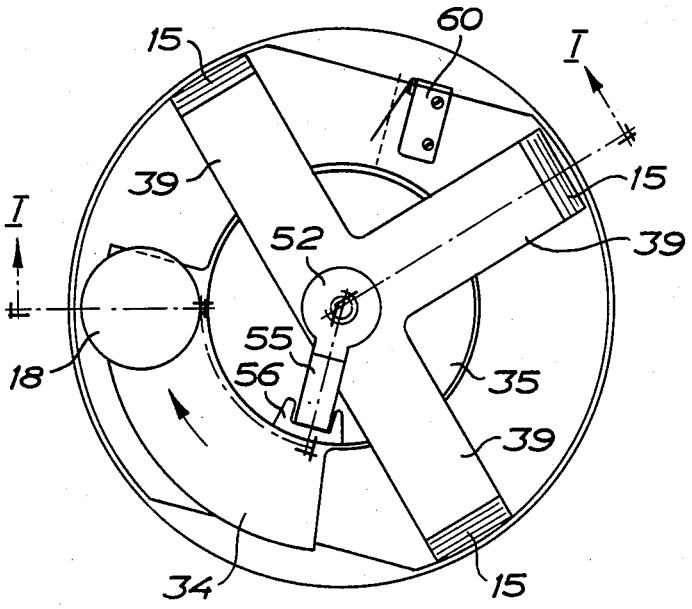
Figure 3:
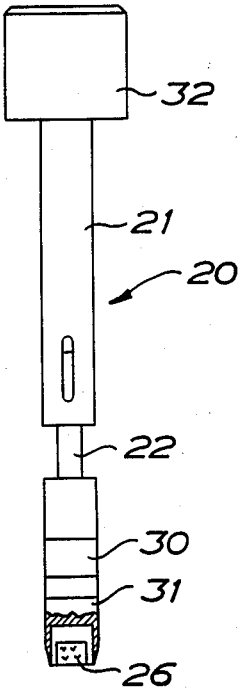
Figure 4:
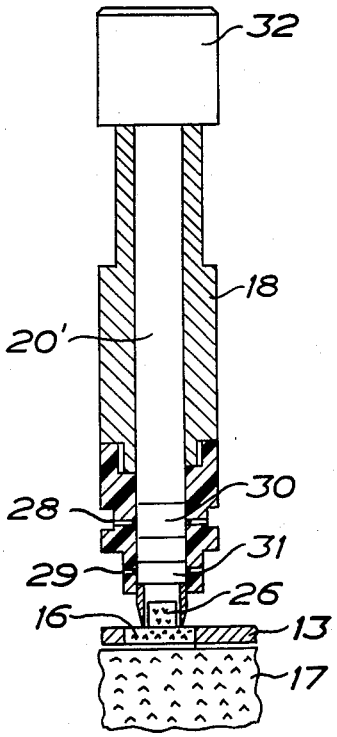
Figure 5:
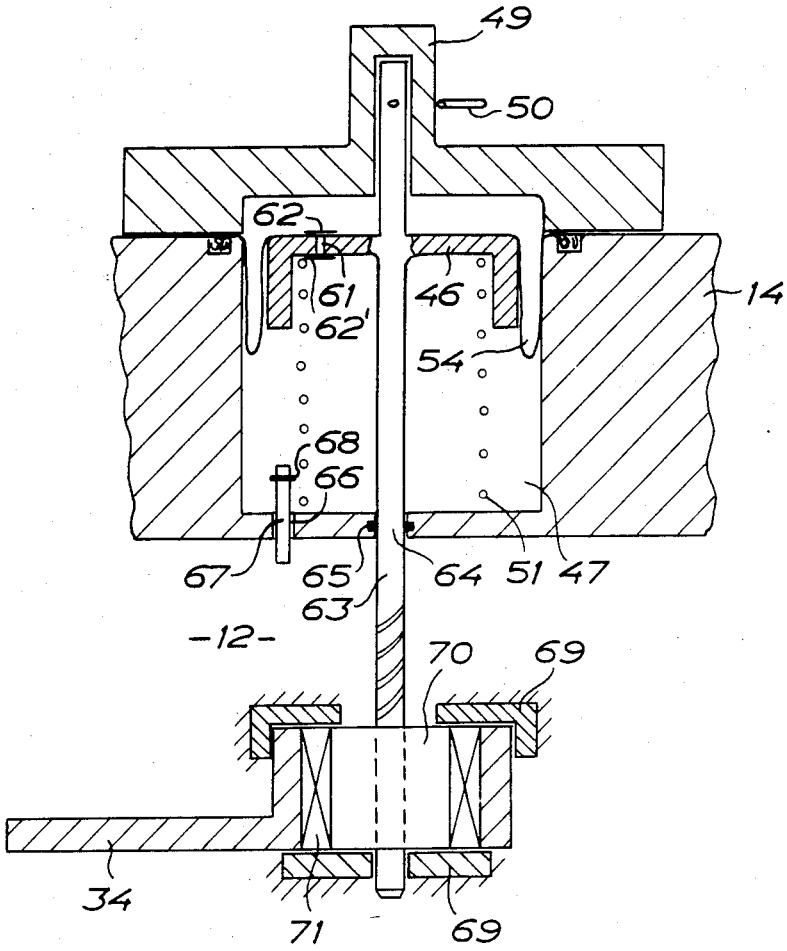

FIG. 1 is a vertical cross-sectional view of the arming device mounted to a mine, the section being taken along line I—I in FIG. 2 and the device being shown in the safe condition thereof, FIG. 2 is a plan view of the arming device with some parts thereof shown in cross section along the plane of the lower side of the cover of the device, FIG. 3 is an elevational view, partly a cross-sectional view, of the detonator unit, separated from the arming device, in the embodiment shown in FIGS. 1 and 2, FIG. 4 is an elevational view of the detonator unit in another embodiment thereof with said unit inserted into the housing which is shown in axial cross-sectional view, and FIG. 5 is a fragmentary elevational view of the arming device, which discloses a modified embodiment of the actuating means of the interruptor.

Referring to FIGS. 1 and 2, a sea mine comprises a casing 10 containing a main charge 11. The casing 10 forms a space 12 which is the instrument housing of the mine, the arming device of the mine being located therein. This device comprises a bottom plate 13 and a cover 14, the bottom plate and the cover being interconnected by means of cantilever beams 15. In an aperture in the bottom plate 13, a transfer charge 16 is located, and below the bottom plate a booster charge 17 is located.

In the cover 14, there is a housing 18 fixedly connected therewith and having an axially through bore 19 for receiving a detonator unit 20 therein, said unit being shown separately in FIG. 3. It comprises a telescopic shaft consisting of a tube 21 and another element 22 displaceably received therein, which forms the detonator proper. The element 22 is biased by means of a pressure ring 23 received in the tube 21, and displacement of said element in the tube is limited by means of a cross pin 24 passing through the element 22 and extending into axial slots 25 in the tube 21.

In the lower end of the element 22 a detonator charge 26 is provided, and this end is received by an extension 27 of the housing 18, which consists of electrically insulating material and in which electric contacts 28 and 29 are provided for co-operation with electric contacts 30 and 31 on the element 22. These contacts preferably are gold-plated. The detonator can be slid from the outside into the cylinder bore 19 in the housing 18, 27 and is positioned by means of a cap 32 screwed onto the housing, O-rings 33 being provided at the upper end of the detonator unit to seal between his unit and the bounding surface of the cylinder bore 19. Under the bias of the spring 23 the lower end of the element 22 is engaged with an interruptor 34 forming part of the arming device, which in the safe condition of the device keeps the detonator charge 26 positively separated from the transfer charge 16. In this position, the contacts 30 and 31 do not engage the contacts 28 and 29.

The interruptor 34 can be made of solid metal but preferably it comprises a sandwich structure which is made up of different materials, some being effective for absorbing particle flow from the detonator charge 26 if it detonates, and others being effective for attenuating the propagation of the detonation wave. The interruptor is fixedly connected with a housing 35, the interruptor and the housing being journalled on a pin 36 attached to the bottom plate 13, for rotational movement about a vertical axis. In the housing 35, a clock spring 37 is provided, which is not tensioned normally and thus exerts no torque on the housing 35 and the interruptor 34 connected therewith. The inner end of the spring is attached to a spindle 38 which is rotatably mounted in the housing 35 and also in a partition 39 supported by the contilever beams 15.

The housing 35 and the interruptor 34 define a space 40 which is filled with silicon oil of high viscosity, and a disc 41 is received by said space. By means of a pin 42 the disc is non-rotatably but axially displaceably connected with the journal pin 36 by the pin 42 being inserted into the disc 41 as well as the journal pin 36. In the housing 35 there is provided a recess 43 in which there is located a helical pressure spring 44 biasing the disc 41 towards a distance element arranged between the disc and the interruptor 34 such that there exists between the disc 41 and the interruptor 34 a gap of a predetermined size and there exists a gap also between the disc 41 and the housing 35. These gaps should be of the order 0.1 mm and are filled with the silicon oil contained in the space 40. The disc 41 located in the space 40 and the silicon oil form a viscosity brake for retarding the rotation of the interruptor 34 under the bias of the spring 37 when tensioned. The spring is tensioned by means of a hydrostatic starting device which will now be described in more detail.

On the spindle 38 there is axially displaceably mounted a piston 46 which is received by a cylinder bore 47 in the cover 14. A pin 48 fixedly connected with the piston 46 is received for axial displacement in a hood 49 attached to the cover 14. The pin can be locked against axial displacement by means of a transport safety pin 50 which can be inserted through apertures in the pin 48 and the hood 49. The piston is biased by means of a pre-tensioned pressure spring 51 in the cylinder bore 47 and is connected with a nut 52 non-rotatably but axially displaceably mounted, which engages a screw-threaded portion 53 of the spindle 38. A roll membrane 54 forms a sealing between the piston 46 and the cover 14 in the cylinder bore 47. An arm 55 on the nut 52 can be engaged with an abutment 56 on a projecting arm 57 connected with the housing 35. The screw-threaded portion 53 has such a pitch that the spindle will be rotated to tension the spring 37 by axial displacement of the nut 52 downwards along the spindle 38 while the housing 35 and the interruptor 34 are held stationary by the abutment 56 engaging the arm 55 on the nut 52.

When preparing the mine for combat the separately stored detonator unit 20 is inserted into the cylinder bore 19 in the housing 18, the telescopically arranged detonator unit being compressed against the bias of the spring 23 when the detonator unit is engaged with the interruptor 34. The detonator unit will be maintained in the position thereof by means of the screwed-on cap 32, and the O-rings 33 prevent sea water from penetrating into the cylinder bore 19 when the mine is sinking. When the detonator unit has been applied in this manner the contacts 30 and 31 do not engage the contacts 28 and 29, respectively. The interruptor 34 is positively secured in the position shown, wherein the interruptor keeps the detonator charge 26 separated from the transfer charge 16 by the piston 46 and thus the nut 52 by means of the inserted safety pin 50 being held in the shown upper position thereof, in which the housing 35 and thus the interruptor 34 are held in the rotated position shown by the engagement of the arm 55 and the abutment 56. As will be clear from the description above, the spring 37 under the circumstances is not tensioned such that there is exerted no torque on the housing 35 and the interruptor 34, respectively. The detonator unit accordingly can be mounted at any time before the mine is launched; also after mounting of the detonator unit the safety is fully guaranteed.

Shortly before launching of the mine the transport safety pin 50 is removed such that the piston 46 will no longer be locked but nevertheless will remain in the position shown, the rest or safe position, due to the fact that it is held in this position by the pre-tensioned spring 51. Then, when the mine has been launched, sea water will be able to penetrate through the apertures in the hood 49 previously receiving the transport safety pin 50, and will be able to pass through an existing gap between the pin 48 and the hood 49 such that a hydrostatic pressure can be built-up at the upper side of the piston 46. At a certain depth, e.g. 3 m, the hydrostatic pressure will overcome the pre-tension of the spring 51 such that the piston 46 will start to move downwards. This means that the spindle 38 will be rotated by the screw engagement between the nut 42 and the screw-threaded portion 53. The spring 37 will be tensioned by the rotation of the spindle and thus will exert a torque on the housing 35 and accordingly on the interruptor 34. However, no rotation of the interruptor will take place because such rotation will be prevented by the engagement between the arm 45 and the abutment 46 but only initially under the movement of the piston 46, because the arm 55 during the axial movement of the nut 52 downwards eventually will disengage the abutment 56 so that the housing 35 and the interruptor 34 will be released for rotation under the action of the tensioned spring 37. This can take place e.g. at a depth of 5 m, and the rotation of the spindle 38 thus effected may be of the order of ½–1 revolution. The rotation of the housing 35 and the interruptor 34 by means of the energy stored in the spring 37 will not take place abruptly, however, but will take place slowly due to the braking effect exerted by the disc 41 in the space 40 filled with silicon oil. The rotational speed of the interruptor may be e.g. of the order of ¼ revolution for 30 minutes.

When the housing 35 and the interruptor 34 have been rotated over a certain angle, the interruptor will be completely withdrawn from the detonator unit 20 such that the element 22 forming the detonator proper, will move downwards under the bias of the spring 23 to engage the transfer charge 16. Then, the contacts 30 and 31 on the element 22 will engage the contacts 28 and 29, respectively. These contacts form part of the electric or electronic system of the mine, not described in detail here, which can comprise also a micro-switch 58 actuated by an arm 59 on the nut 52 when the nut moves downwards, to cause e.g. connection of the batteries of the mine to the electric or electronic system of the mine, and a micro-switch 60 actuated by the interruptor 34 when it is close to the completely withdrawn position thereof, e.g. to cause interruption of short-circuiting of the detonator, if any, and/or connection of the detonator electrically to the ignition system of the mine.

The mine is now armed if arming means that the explosive components have been brought in such position that ignition can be transferred from the detonator to the main charge. However, upon this there is often arranged an electronic arming delay making firing of the mine impossible for a predetermined period after launching.

The detonator unit can also be constructed according to the modification of FIG. 4. In this case, the detonator unit which is designated generally 20' in FIG. 4, is not telescopic but is made as an integral piece. Thus, it will take a fixed position after having been inserted into the housing 18, the lower end thereof being located a fraction of a millimeter above the interruptor 34. In this case the contacts 30 and 31 engage the stationary contacts 28 and 29, respectively, micro-switches actuated by the piston 46 and the interruptor 34, respectively, being able to keep these contacts short-circuited and/or electrically separated from the ignition circuit of the mine, which ever is preferred. When the interruptor 34 has been withdrawn from the lower end of the detonator unit there will be an air gap between this end and the transfer charge, and this air gap should have a maximum size allowing the detonator to ignite the transfer charge 16. Certain detonators can effect ignition over a gap of e.g. 8 mm.

An alternative manner of effecting a slow rotational movement of the interruptor 34 by means of water pressure on the roll membrane 54 is shown in FIG. 5.

The piston 46 in the chamber 47 forms a choking aperture 61 which may have a diameter of the order of 0.1 mm. The choking aperture 61 is protected at the inlet and outlet thereof against the penetration of dirt by means of filters 62 and 62', respectively. The piston 46 co-operates as previously described with a pre-tensioned spring 51 and it is rigidly connected with a spindle 63 extending through an aperture 64 in the cover 14, sealed by means of an O-ring 65 in the cover 14.

The chamber 47 in the position shown is connected with the much larger space 12 (the instrument housing of the mine) by means of an air passage 66. In this passage there is mounted with proper axial friction a pin 67. The pin normally does not prevent air exchange between the chamber 47 and the space 12 but if the pin 67 is depressed, which takes place when the piston 46 moves downwards to the bottom position thereof, an O-ring 68 on the pin 67 closes the air passage 66 and then the chamber 47 will be completely sealed against the space 12.

The spindle 63 is provided with a non-selfrestraining thread which co-operates with a nut 70 mounted for rotation in a journal 69. When the spindle 63 moves downwards or upwards, the nut 70 is positively rotated. The nut is connected with the interruptor 34 by means of a suitable one way clutch 71 such that the rotational movement of the nut 70 when the spindle 63 moves downwards, does not affect the interruptor 34 while the rotational movement of the nut, when the spindle 63 moves upwards, will be transferred to the interruptor 34.

The function will be as follows:

When the mine is sinking, a hydrostatic pressure will build up at the upper side of the piston 46. This will be pressed downwards as soon as the pre-tension of the spring 51 has been overcome. Air will flow from the chamber 47 to the larger space 12 such that no air compression in the chamber 47 will counteract the movement of the piston 46. When the piston 46 has come close to the bottom position thereof, it will actuate the pin 67 such that the pin will be pushed into the passage 66 and the O-ring 68 from now on will provide a seal between the chamber 47 and the space 12.

The stroke of the piston 46 actually will be effected in a few seconds (a mine will sink e.g. at 1.5 m/s, and the spring 51 can be chosen e.g. in such a way that the piston 46 will be fully depressed 2 m after the movement thereof started). Therefore, the amount of water that will be able to flow through the choking aperture 61 into the chamber 47 before the sealing action of the ring 68 has started, will be insignificant.

Now, water will continuously flow through the choking aperture 61 into the chamber 47 wherein the pressure will rise. When the pressure has increased to such a value that the pressure difference over the choking aperture 61 corresponds to the force exerted by the spring 51 divided by the area of the roll membrane (the piston), the piston 46 will start a slow motion upwards. The speed will be determined by the flow through the choking aperture 61, which in turn is dependent on the pressure difference over the choking aperture, which as mentioned above is independent of the surrounding water pressure (determined by the spring bias and the piston area only, if existing frictional forces are neglected).

When the piston 46 performed the downward movement thereof, the interruptor 34 was not actuated. However, when the piston now performs the slow motion upwards thereof, the interruptor will be rotated under the action of the nut 70 and the one way clutch 71.

The advantage of the principle now described over the viscosity brake principle is that the arming time will be independent of temperature. The viscosity of a silicon oil in fact varies with the temperature such that the arming time when mines are launched in hot weather may be of the order 50% shorter than the arming time at launching in cold weather.

We claim:

1. An arming device for sea mines, comprising an electric detonator; a transfer charge; and an interruptor which can be inserted between the detonator and the transfer charge, for separating the detonator and the transfer charge; the detonator being arranged as part of a separate unit shaped to be inserted in a space in a housing arranged in the arming device; the separate unit having a telescopic element, with a spring engaged with the telescopic element for pressing the detonator towards the interruptor; and cooperating electric contacts arranged on the unit and in the space, respectively, for the electric connection of the detonator upon insertion in the space.

2. An arming device according to claim 1, in which the unit is fixed in the inserted position, with a gap between the detonator and the interruptor.

3. An arming device according to claim 2, comprising a latching means for latching the interruptor in the position thereof in which it is inserted between the detonator and the transfer charge.

4. An arming device according to claim 2, comprising a spring for biasing the interruptor against displacement thereof from the position between the detonator and the transfer charge.

5. An arming device according to claim 4, comprising a hydrostatically actuated means and a means for latching the interruptor, operatively connected with the hydrostatically actuated means, to release the interruptor at predetermined hydrostatic pressure after launching of the mine, by actuation of the latching means.

6. An arming device according to claim 5, in which the hydrostatic means is operatively connected with a spring, for tensioning the spring so as to spring bias the interruptor under the action of hydrostatic pressure.

7. An arming device according to claim 1, in which the spring engaged with the telescopic element presses the detonator against the interruptor.

8. An arming device for sea mines comprising an electric detonator; a transfer charge; and an interruptor shaped to be inserted between the detonator and the transfer charge for separating the detonator and the transfer charge; the detonator being arranged as part of a separate unit shaped to be inserted in a space in a housing arranged in the arming device; cooperating electric contacts being arranged on the unit and in the space, respectively, for electric connection of the detonator upon insertion thereof into the space; and latching means for latching the interruptor in the position thereof in which it is inserted between the detonator and the transfer charge.

9. An arming device for sea mines comprising an electric detonator, a transfer charge, and an interruptor shaped to be inserted between the detonator and the transfer charge for separating the detonator and the transfer charge; the detonator being arranged as part of a separate unit shaped to be inserted in a space in a housing arranged in the arming device; cooperating electric contacts arranged on the unit and in the space, respectively, for the electric connection of the detonator upon insertion thereof into the space; and a hydrostatically actuated means operatively connected over a one way clutch with the interruptor, and displaceable against spring bias under the reaction of hydrostatic pressure, and by a pressure equalizing means actuated by such displacement, for initiating the return of the hydrostatically actuated means under spring bias; the one way clutch being arranged to transmit the return movement to the interruptor, for the displacement thereof to the position between the detonator and the transfer charge.

10. A sea mine combination that is not ready for combat but can be made so by combining parts associated therewith; the parts comprising:

(1) a sea mine;

(2) a detonator-less arming device; and (3) a detonator readily and easily combined with the arming device at the time the sea mine is to be made ready for combat;

(a) the detonator-less arming device being mounted in a space in the sea mine;

(b) a cover exteriorly of the mine and closing said space;

(c) the arming device comprising:

(i) a transfer charge;

(ii) an interruptor having a safety position;

(iii) an elongated tubular housing having open ends and extending through the cover, so that one end is open to the exterior of the mine, the other end of the housing facing the transfer charge, but separated therefrom by the interruptor in the safety position thereof;

(iv) a removable cap closing the open end of the housing; and (v) stationary electric contacts in the housing forming part of an ignition circuit; and (vi) an electric detonator unit separately disposed from the arming device and adapted to be readily and easily mounted in the housing of the arming device through said opening when the mine is to be prepared for combat, said detonator unit comprising an elongated element, a detonator charge at one end of said element located at said other end of the housing when the detonator unit is mounted therein, and electric contacts for cooperation with said electric contacts in the housing when the detonator unit is mounted therein.

11. A sea mine combination according to claim 10, in which the electric detonator unit comprises telescopic elements, with a spring engaged therebetween for pressing the detonator against the interruptor.

12. A sea mine combination according to claim 10, in which the detonator unit is fixed in the inserted position after assembly therewith, with a gap between the detonator and the interruptor.

13. A sea mine combination according to claim 10, having a spring biasing the interruptor for displacement thereof from the position between the detonator and the transfer charge.

14. A sea mine combination according to claim 10, comprising a latching means for latching the interruptor in the position thereof in which it is inserted between the detonator and the transfer charge.

15. A sea mine combination according to claim 14, comprising a hydrostatically-actuated means which is operatively connected to the means for latching the interruptor, to release the interruptor at a predetermined hydrostatic pressure after launching of the mine, by actuation of the latching means.

16. A sea mine combination according to claim 15, in which the hydrostatic means is operatively connected to a spring for tensioning the spring so as to spring bias the interruptor under the action of a hydrostatic pressure.

17. A sea mine combination according to claim 10, having a hydrostatically actuated means operatively connected by way of a one-way clutch with the interruptor, and which is displaceable against spring bias under the action of hydrostatic pressure; and a pressure-equalizing means actuated by displacement thereof under such action for initiating the return of the hydrostatically-actuated means under spring bias; the one way clutch being arranged to transmit the return movement of the interruptor, for the displacement thereof to the position between the detonator and the transfer charge.

* * * * *